US006941919B2

(12) United States Patent
Chiba et al.

(10) Patent No.: US 6,941,919 B2
(45) Date of Patent: Sep. 13, 2005

(54) GENERAL PURPOSE ENGINE

(75) Inventors: Shosaku Chiba, Saitama (JP); Kazuhiro Sakamoto, Saitama (JP); Shoji Kawase, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/694,390

(22) Filed: Oct. 28, 2003

(65) Prior Publication Data

US 2004/0134458 A1 Jul. 15, 2004

(30) Foreign Application Priority Data

Nov. 1, 2002 (JP) ..... 2002-319488

(51) Int. Cl.[7] ..... F02F 7/00
(52) U.S. Cl. ..... 123/195 A; 123/195 C
(58) Field of Search ..... 123/195 R, 195 C, 123/195 A

(56) References Cited

U.S. PATENT DOCUMENTS 5,421,297 A 6/1995 Tamba et al.
6,250,273 B1 * 6/2001 Ryu et al. ..... 123/195 C
2002/0011230 A1 1/2002 Furuya

FOREIGN PATENT DOCUMENTS

JP 2001-329910 11/2001

OTHER PUBLICATIONS

Patent abstract of JP 2002147213 published May 22, 2002.

* cited by examiner

*Primary Examiner*—Henry C. Yuen
*Assistant Examiner*—Hyder Ali
(74) *Attorney, Agent, or Firm*—Arent Fox PLLC

(57) ABSTRACT

In a general purpose engine, a crankcase is formed from a case main body and a cover secured to the case main body, and a bearing support member is disposed between a drive transmission wheel and a crank web that is at one end in the axial direction. The bearing support member is formed into a shape that allows oil held within the crankcase to flow between opposite sides of the bearing support member and is mounted on the case main body.

5 Claims, 2 Drawing Sheets

GENERAL PURPOSE ENGINE

BACKGROUND OF THE INVENTION

1. Field of the Invention

The present invention relates to a general purpose engine in which a case main body, which is a principal part of a crankcase, is integrally formed with a cylinder block, a crankshaft having a plurality of crank webs is rotatably supported via bearings in the case main body and a bearing support member mounted on the case main body, and a drive transmission wheel housed within the crankcase so as to transmit rotational power to a valve operating mechanism is fixedly provided on the crankshaft so as to be outside the crank web that, among the crank webs, is at one end in the axial direction.

2. Description of the Related Art

A general purpose engine in which a crankcase is formed from a case main body and a cover joined to the case main body, and the cover is used as a bearing support member, is already known from, for example, Japanese Patent Application Laid-open No. 2001-329910.

However, in this conventional arrangement, the cover (the bearing support member) is disposed outside a drive transmission wheel fixedly provided on a crankshaft so as to be outside a crank web that is at one end in the axial direction. Consequently, the distance between a crankpin and the cover is comparatively long, and thus the rigidity with which the crankshaft is supported is comparatively low. As a result of a load acting on the crankshaft in a direction perpendicular to the axial direction during a combustion stroke, etc., a comparatively large knocking sound is generated in a gap between the crankshaft and a bearing supported by the bearing support member.

In order to solve this problem, it is conceivable that the bearing support member, which is a separate member from the crankcase, is mounted on the case main body inside the cover, and the distance between the crankpin and the bearing support member is made comparatively short, to thereby enhance the rigidity with which the crankshaft is supported. However, when the interior of the crankcase is divided into two by means of the bearing support member, the amount of oil that can be held within the crankcase becomes small, leading to a possibility that the continuous operation time might be reduced. If an attempt is made to ensure a sufficient amount of oil, the dimensions of the crankcase, and consequently those of the general purpose engine become too large.

SUMMARY OF THE INVENTION

The present invention has been achieved in view of the above-mentioned circumstances, and it is an object thereof to provide a general purpose engine that can hold a sufficient amount of oil within a crankcase while avoiding any increase in dimensions, enhance the rigidity with which a crankshaft is supported, and suppress the generation of a knocking sound.

In order to accomplish this object, the present invention provides a general purpose engine in which a case main body, which is a principal part of a crankcase, is integrally formed with a cylinder block, a crankshaft having a plurality of crank webs is rotatably supported via bearings in the case main body and a bearing support member mounted on the case main body, and a drive transmission wheel housed within the crankcase so as to transmit rotational power to a valve operating mechanism is fixedly provided on the crankshaft so as to be outside the crank web that, among the crank webs, is at one end in the axial direction, wherein the crankcase is formed from the case main body and a cover secured to the case main body, and wherein the bearing support member, which is disposed between the drive transmission wheel and the crank web that is at one end in the axial direction, is formed into a shape that allows oil held within the crankcase to flow between opposite sides of the bearing support member and is mounted on the case main body.

In accordance with this arrangement, since the bearing support member is disposed in a position in the proximity of the crank web that is at one end in the axial direction, the rigidity with which the crankshaft is supported can be enhanced, thereby suppressing the knocking sound generated in a gap between the crankshaft and the bearing supported by the bearing support member. Moreover, since the bearing support member has a shape that can allow oil held within the crankcase to flow between opposite sides of the bearing support member, the amount of oil held within the crankcase is not be reduced due to the bearing support member being placed within the crankcase, thereby storing a sufficient amount of oil within the crankcase while avoiding any increase in the dimensions of the engine.

The above-mentioned object, other objects, characteristics, and advantages of the present invention will become apparent from an explanation of a preferred embodiment that will be described in detail below by reference to the attached drawings.

BRIEF DESCRIPTION OF THE DRAWINGS

FIG. 1 is a longitudinal cross-sectional view of a general purpose engine with its cover removed, corresponding to a cross-sectional view along line 1—1 in FIG. 2.

FIG. 2 is a cross-sectional view along line 2—2 in FIG. 1.

DESCRIPTION OF THE PREFERRED EMBODIMENT

Figure 1:
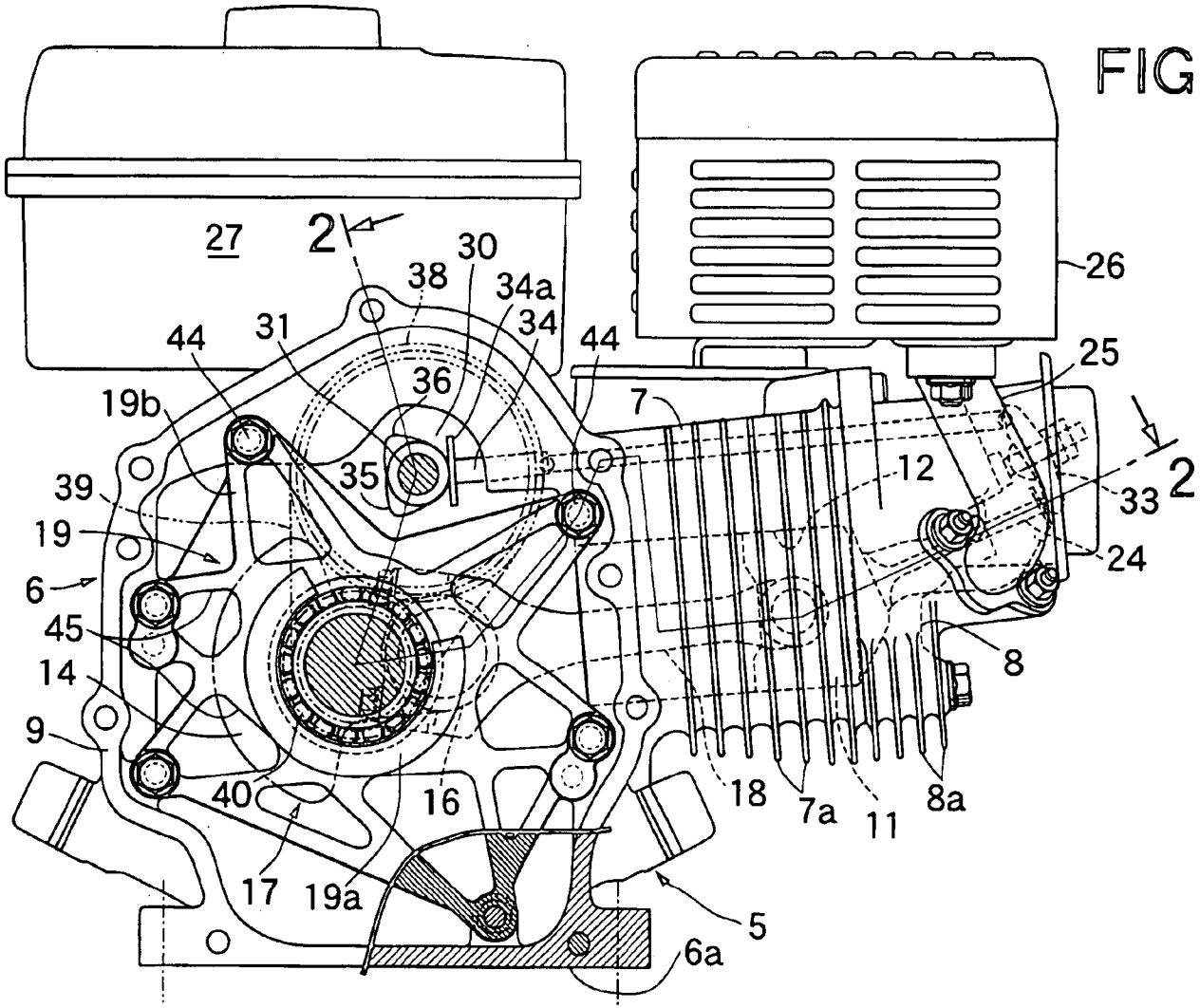
FIG. 1 to FIG. 2 illustrate one embodiment of the present invention.
Figure 2:
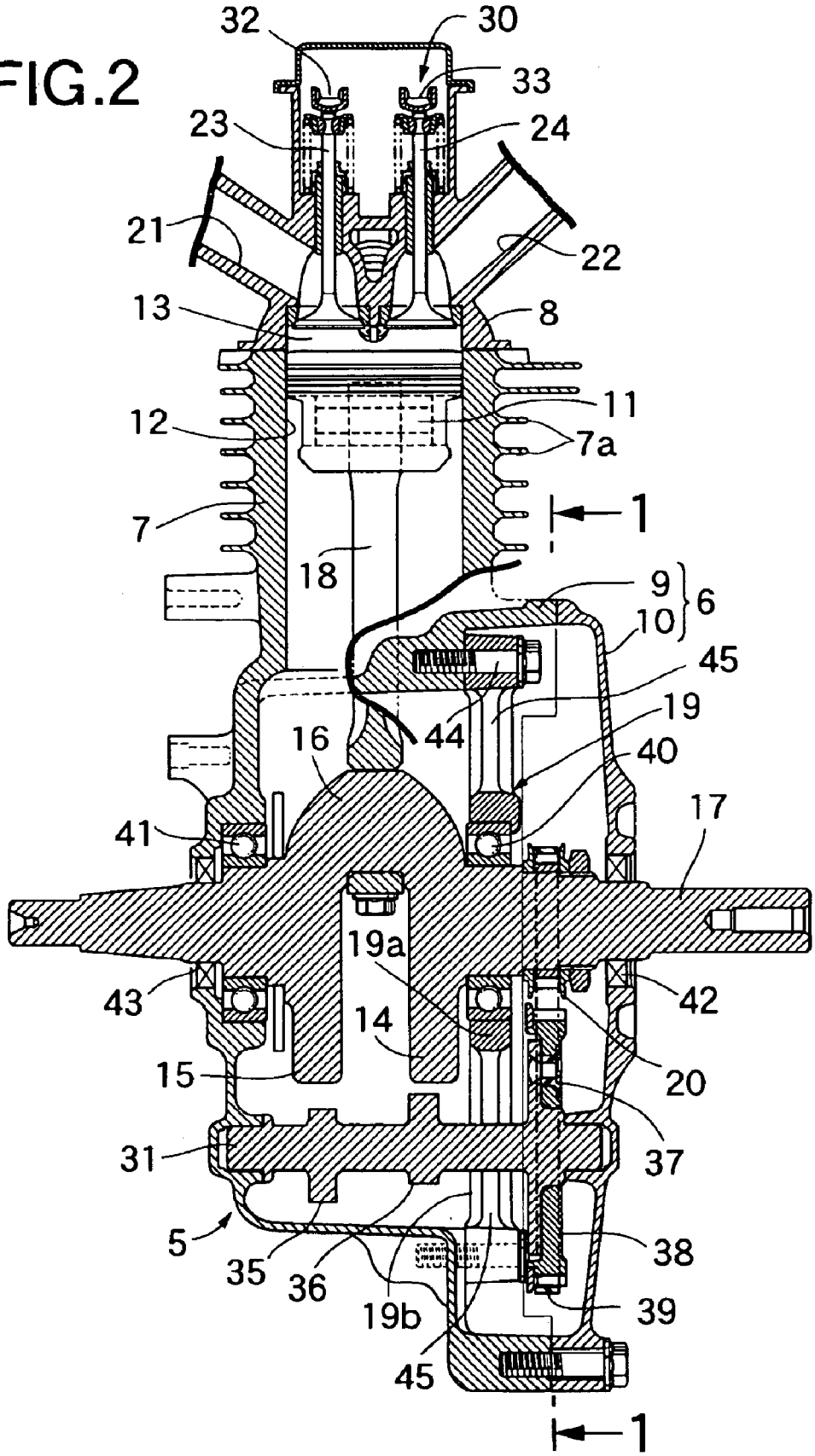

As shown in FIG. 1 and FIG. 2, this general purpose engine is an air-cooled single-cylinder engine used in, for example, a work machine. An engine main body 5 is formed from a crankcase 6, a cylinder block 7 projecting at a slightly upward inclination from one side face of the crankcase 6, and a cylinder head 8 joined to a head part of the cylinder block 7. A large number of air-cooling fins 7*a* and 8*a* are provided on the outer side faces of the cylinder block 7 and the cylinder head 8. The crankcase 6 is mounted on an engine bed of various types of work machine via a mounting face 6*a* which is a lower face of the crankcase 6.

The crankcase 6 is formed from a case main body 9 and a cover 10. The case main body 9 is a principal part of the crankcase 6 and is formed integrally with the cylinder block 7. The cover 10 is secured to the case main body 9 so as to close an opening of the case main body 9 in a liquid-tight manner.

Formed in the cylinder block 7 is a cylinder bore 12 into which a piston 11 is slidably fitted. Formed between the cylinder block 7 and the cylinder head 8 is a combustion chamber 13 which the top of the piston 11 faces.

A crankshaft 17 has a plurality, for example, a pair, of crank webs 14 and 15, and a crankpin 16 providing a connection between the two crank webs 14 and 15. The piston 11 is connected to the crankshaft 17 via a connecting rod 18 and the crankpin 16. This crankshaft 17 is rotatably supported by the case main body 9 and a bearing support member 19 mounted on the case main body 9 via ball bearings 41 and 40, respectively. A drive pulley 20, which is a drive transmission wheel housed in the crankcase 6, is fixedly provided on the crankshaft 17 so as to be outside the crank web 14 that, among the crank webs 14 and 15, is at one end in the axial direction.

Provided in the cylinder head 8 are an intake port 21 and an exhaust port 22 that communicate with the combustion chamber 13. Disposed in the cylinder head 8 are an intake valve 23 for opening and closing the communication between the intake port 21 and the combustion chamber 13, and an exhaust valve 24 for opening and closing the communication between the exhaust port 22 and the combustion chamber 13. An exhaust pipe 25 has its upstream end connected to the exhaust port 22 and its downstream end connected to an exhaust muffler 26 that is supported by and disposed above the cylinder block 7. Disposed above the case main body 9 of the crankcase 6 is a fuel tank 27 which is supported by the case main body 9.

A valve operating mechanism 30 for opening and closing the intake valve 23 and the exhaust valve 24 is formed from a camshaft 31, an intake rocker arm 32, an exhaust rocker arm 33, and pushrods 34. The camshaft 31 is rotatably supported in the crankcase 6 so as to have an axis parallel to the crankshaft 17. The intake rocker arm 32 is rockably supported in the cylinder head 8 so as to have one of its ends abutting against the intake valve 23 which is spring-biased in a closing direction. The exhaust rocker arm 33 is rockably supported in the cylinder head 8 so as to have one of its ends abutting against the exhaust valve 24 which is spring-biased in a closing direction. Each of the pushrods 34 has one end abutting against the other end of the corresponding one of the rocker arms 32 and 33, and follows the rotation of the camshaft 31 so as to operate in the axial direction.

An intake cam 35 and an exhaust cam 36 are integrally formed on the camshaft 31. The pushrods 34 run through the cylinder block 7 in an axially movable manner, and are disposed between the cylinder head 8 and the crankcase 6. Provided on the other end of each of the pushrods 34 is a sliding-contact plate 34*a* which is in sliding contact with the corresponding one of the intake cam 35 and the exhaust cam 36.

The two pushrods 34 operate in the axial direction in accordance with the cam profile of the corresponding cams 35 and 36 in response to rotation of the camshaft 31. As a result, the intake valve 23 and the exhaust valve 24 are driven to open and close with operating characteristics corresponding to the cam profile of the intake cam 35 and the exhaust cam 36.

Power is transmitted to this valve operating mechanism 30 from the drive pulley 20. An endless timing belt 39 is wound around the drive pulley 20 and a driven pulley 38 which is mounted on the camshaft 31 via a damper rubber 37 at a position corresponding to the drive pulley 20. The rotational power of the crankshaft 17 is transmitted to the camshaft 31 at a reduction ratio of 1/2.

The bearing support member 19 is mounted on the case main body 9 between the drive pulley 20 and the crank web 14 which, among the crank webs 14 and 15 of the crankshaft 17, is at one end in the axial direction, that is, at a position so that the drive pulley 20 is interposed between the bearing support member 19 and the cover 10. One end of the crankshaft 17 runs rotatably through the bearing support member 19 and the cover 10. The ball bearing 40 is disposed between the bearing support member 19 and the crankshaft 17. An annular seal 42 is disposed between the cover 10 and the crankshaft 17. The other end of the crankshaft 17 runs rotatably through the case main body 9. The ball bearing 41 is disposed between the case main body 9 and the crankshaft 17. An annular seal 43 is disposed outside the ball bearing 41.

The bearing support member 19 is formed integrally from an annular support portion 19*a* and a mounting portion 19*b* projecting radially outward from the support portion 19*a*. The annular support portion 19*a* supports the ball bearing 40. The bearing support member 19 is mounted on the case main body 9 by means of bolts 44 at a plurality of, for example, six positions spaced in the circumferential direction on the outer periphery of the mounting portion 19*b*. The mounting portion 19*b* is formed so that sections between the plurality of positions where the bolts are inserted through are indented toward the support portion 19*a*. A plurality of through holes 45 are also formed in the mounting portion 19*b*.

That is, the bearing support member 19 is formed into a webbed shape that allows oil held within the crankcase 6 to flow between opposite sides of the bearing support member 19 through the through holes 45. See FIG. 1. The camshaft 31, which has opposite ends rotatably supported by the case main body 9 and the cover 10 of the crankcase 6, is also disposed so as to run through an empty space formed between the bearing support member 19 and the case main body 9.

The operation of this embodiment is now explained. The crankcase 6 is formed from the case main body 9 and the cover 10 joined to the case main body 9, the case main body 9 being integrally formed with the cylinder block 7. The crankshaft 17 having the pair of crank webs 14 and 15 is rotatably supported by the bearing support member 19 and the case main body 9 via the ball bearings 40 and 41, respectively. The bearing support member 19 is disposed between the drive pulley 20 and the crank web 14 that, among the crank webs 14 and 15, is at one end in the axial direction, the drive pulley 20 being housed within the crankcase 6 and fixed to the crankshaft 17 so as to transmit rotational power to the valve operating mechanism 30. As a result, the bearing support member 19 is disposed at a position in the proximity of the crank web 14 that is at one end in the axial direction, thus enhancing the rigidity with which the crankshaft 17 is supported and suppressing the knocking sound generated in a gap between the crankshaft 17 and the ball bearing 40 supported by the bearing support member 19.

Moreover, since the bearing support member 19 is formed into the shape that allows oil held within the crankcase 6 to flow between opposite sides of the bearing support member 19 through the through holes 45, the amount of oil held within the crankcase 6 is not be reduced due to the bearing support member 19 being placed within the crankcase 6, thereby storing a sufficient amount of oil within the crankcase 6 while avoiding any increase in the dimensions of the engine.

Although an embodiment of the present invention is explained in detail above, the present invention is not limited to this embodiment, and the present invention can be modified in a variety of ways without departing from the subject matter of the present invention.

For example, in the above-mentioned embodiment, a single-cylinder general purpose engine is explained, but the present invention is also applicable to a multi-cylinder general purpose engine.

What is claimed is:

1. A general purpose engine comprising:

a crankcase comprising a case main body as a principal part thereof;

a cylinder block with which the case main body is integrally formed;

a crankshaft having a plurality of crank webs;

bearings;

a bearing support member mounted on the case main body, the crankshaft being rotatably supported via the bearings in the bearing support member and the case main body;

a valve operating mechanism; and a drive transmission wheel housed within the crankcase so as to transmit rotational power to the valve operating mechanism, the drive transmission wheel being fixedly provided on the crankshaft so as to be outside the crank web that, among the crank webs, is at one end in the axial direction;

wherein the crankcase comprises the case main body and a cover secured to the case main body;

wherein the bearing support member, which is formed with a plurality of through holes and is disposed between the drive transmission wheel and the crank web that is at one end in the axial direction, is formed into a shape that allows oil held within the crankcase to flow between opposite sides of the bearing support member through the through holes and is mounted on the case main body, wherein the bearing support member is formed from an annular support portion for supporting one of the bearings and a mounting portion integrally projecting radially outward from the support portion and having circumferentially paced projecting portions.

2. The general purpose engine according to claim 1, wherein the mounting portion comprises said plurality of through holes.

3. The general purpose engine according to claim 1, wherein the bearing support member is mounted on the case main body at said circumferentially spaced projecting portions.

4. The general purpose engine according to claim 3, wherein the mounting portion is formed so that sections between the circumferentially spaced projecting portions are indented toward the support portion.

5. The general purpose engine according to claim 1, wherein the bearing support member is formed into a webbed shape.

* * * * *